US007354038B2

(12) United States Patent
Watase

(10) Patent No.: US 7,354,038 B2
(45) Date of Patent: Apr. 8, 2008

(54) JAM SUPPRESSING SHEET FEEDING DEVICE AND IMAGE FORMING APPARATUS

(75) Inventor: Hiroyuki Watase, Funabashi (JP)

(73) Assignee: Ricoh Company, Ltd., Tokyo (JP)

( * ) Notice: Subject to any disclaimer, the term of this patent is extended or adjusted under 35 U.S.C. 154(b) by 187 days.

(21) Appl. No.: 10/894,244

(22) Filed: Nov. 26, 2003

(65) Prior Publication Data

US 2005/0073088 A1 Apr. 7, 2005

(30) Foreign Application Priority Data

Nov. 27, 2002 (JP) ..... 2002-344747

(51) Int. Cl.
*B65H 5/00* (2006.01)

(52) U.S. Cl. ..... 271/10.13; 271/122; 271/242; 271/10.12

(58) Field of Classification Search ..... 271/116, 271/122, 242, 10.12, 10.13
See application file for complete search history.

(56) References Cited

U.S. PATENT DOCUMENTS 5,543,909 A * 8/1996 Quesnel ..... 399/394
5,653,434 A * 8/1997 Petocchi et al. ..... 271/122
5,765,825 A 6/1998 Watase
5,816,569 A * 10/1998 Hoshi et al. ..... 271/117
6,263,186 B1 * 7/2001 Okamoto et al. ..... 399/388
2005/0073088 A1 4/2005 Watase

FOREIGN PATENT DOCUMENTS

JP 10-218403 8/1988
JP 09-183529 7/1997

OTHER PUBLICATIONS

U.S. Appl. No. 09/409,587, filed Sep. 30, 1999, unknown.
U.S. Appl. No. 10/347,633, filed Jan. 22, 2003, Watase.
U.S. Appl. No. 10/894,244, filed Nov. 26, 2003, Watase.
U.S. Appl. No. 11/510,681, filed Aug. 28, 2006, Watase et al.
U.S. Appl. No. 11/517,377, filed Sep. 8, 2006, Sagawa et al.

* cited by examiner

*Primary Examiner*—Patrick Mackey
*Assistant Examiner*—Jeremy R Severson
(74) *Attorney, Agent, or Firm*—Oblon, Spivak, McClelland, Maier & Neustadt, P.C.

(57) ABSTRACT

A sheet feeding apparatus includes a sheet tray, a pickup roller, a feed roller, a driving motor to drive the feed roller via a feed clutch, and a reverse roller connected to a reverse shaft driven by the driving motor via a torque limiter. The feed clutch is turned OFF when a trailing edge of a sheet passes through a nip formed between the feed and reverse rollers so as to disconnect the driving motor in order to enable the feed roller to freely rotate. The rotation of the reverse shaft is transmitted to the reverse roller by the operation of the torque limiter so as to enable the reverse roller to rotate and return the next sheet nipped by the reverse and feed rollers in a counter sheet feeding direction.

4 Claims, 9 Drawing Sheets

JAM SUPPRESSING SHEET FEEDING DEVICE AND IMAGE FORMING APPARATUS

CROSS REFERENCE TO RELATED APPLICATION

This application claims priority under 35 USC §119 to Japanese Patent Application No. 2002-344747 filed on Nov. 27, 2002, the entire contents of which are herein incorporated by reference.

BACKGROUND OF THE INVENTION

1. Field of the Invention

The present specification generally relates to a sheet feeding device, feeding sheets one by one, an image forming apparatus including such a sheet feeding device, and, in particular, to a sheet feeding device and image forming apparatus capable of suppressing successive sheet jam occurable when a sheet feeding tray is detached and set.

2. Discussion of Related Art

A sheet feeding device is a well known device used in an image forming apparatus, such as a copier, a printer, a facsimile, an image scanner, a combined machine combining these apparatuses, etc., in order to feed printing sheets and original documents or the like one by one. Such a well known sheet feeding device generally includes a pickup roller 2C that contacts and feeds the topmost sheet P stacked on a sheet feeding tray 1*c* in a direction as shown by the arrow AC in FIG. 9 when rotating. Also included therein are a feed roller 3*c* and a reverse roller 4*c* contacting the feeding roller 3*c* both arranged downstream of the pickup roller 2*c* in a sheet conveyance direction. Such a feed roller 3*c* is connected and driven by a driving motor (not shown) via a feed clutch (not shown) in the sheet feeding direction as shown by the arrow BC. The reverse roller 4*c* is connected, via a torque limiter (not shown), to a reverse shaft 5*c* driven by the driving motor. The rotational direction of each of the rollers 2*c*, 3*c*, and 4*c* will be referred to as "a sheet feeding direction" when each rotates and feeds a sheet P downstream, and "a counter sheet feeding direction" when each reversely rotates and feeds the sheet upstream.

When only a sheet P1 is fed in a nip formed between the feed roller 3*c* and reverse roller 4*c*, the reverse roller 4*c* is engaged and driven by the moving sheet P in the sheet feeding direction as shown by the arrow CC due to a function of the torque limiter. When the next sheet P2 is fed in the nip together with the sheet P1, rotation of the reverse shaft 5*c* is transmitted to the reverse roller 4*c* via the torque limiter, causing the reverse roller 4*c* to rotate in the counter sheet feeding direction as shown by the arrow IC. As a result, the reverse roller 4*c* returns the next sheet P2 in the counter sheet feeding direction as shown by the arrow DC.

The above-mentioned sheet feeding device prevents double-sheet feeding, and is generally referred to as an FRR-type device. In such a known sheet feeding device, the next sheet P2 is stopped and pinched between these feed and reverse rollers 3*c* and 4*c* as shown in FIG. 10 after the last sheet has been launched in a series of sheet feeding operations. In such a situation, if a sheet feeding tray 1*c* is withdrawn in a direction perpendicular to the surface of FIG. 10, for example, an external force is applied to sheet P2, possibly causing successive sheet jam when the sheet feeding tray P2 is set again, because the sheet P2 remains pinched therebetween throughout the operation.

Various sheet feeding devices resolving such a problem have been historically proposed as given infra. However, these devices are complex, have a significantly high cost, and require a large number of component parts. For example, a sheet feeding device discussed in Japanese Patent Application Laid Open No. 10-218403 necessarily includes a reverse clutch to either connect or disconnect a reverse shaft from a reverse roller, thus increasing the cost of the entire apparatus.

SUMMARY OF THE INVENTION

Accordingly, an object of the present invention is to address and resolve such and other problems and provide a new sheet feeding apparatus. Such a novel sheet feeding apparatus includes a sheet tray stacking one or more sheets, a pickup roller feeding the sheet, and a feed roller forwarding the sheet downstream in a sheet feeding direction. A driving motor is provided to drive the feed roller via a feed clutch, selectively connecting transmission the rotation of the driving motor to the feed roller. A reverse roller is provided to contact the feed roller being connected to a reverse shaft driven by the driving motor via a torque limiter. The feed clutch is turned OFF when a trailing edge of a sheet passes through a nip formed between the feed and reverse rollers so as to disconnect the transmission in order to enable the feed roller to freely rotate. The rotation of the reverse shaft is transmitted to the reverse roller by the function of the torque limiter so as to enable the reverse roller to rotate and return the next sheet nipped by the reverse and feed rollers in a counter sheet feeding direction.

In another embodiment, the reverse shaft is driven by the driving motor and the feed clutch is turned OFF so as to disconnect the transmission to the feed roller in order to enable the feed roller to freely rotate before the pickup roller firstly starts feeding the sheet.

In yet another embodiment, the sheet is temporary stopped after its leading edge contacts a pair of registration rollers, thereby deactivating the driving motor while continuously turning ON the feed clutch so as to form and maintain engagement.

In yet another embodiment, an image forming apparatus includes a plurality of the sheet feeding apparatuses having a driving motor of common use.

BRIEF DESCRIPTION OF THE DRAWINGS

A more complete appreciation of the present invention and many of the attendant advantages thereof will be readily obtained as the same becomes better understood by the following detailed description when considered in connection with the accompanying drawings, wherein.

DETAILED DESCRIPTION OF THE INVENTION

Figure 1:
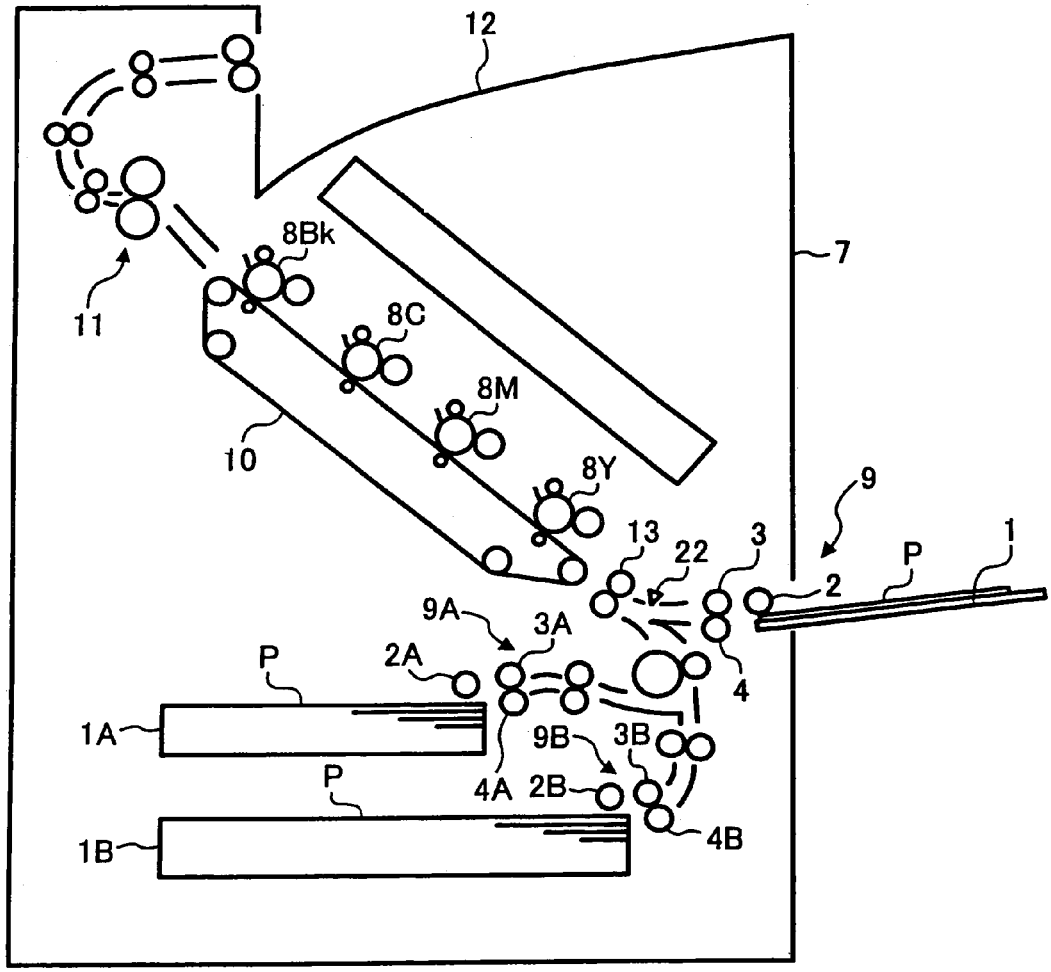
FIG. 1 is a schematic view illustrating an exemplary image forming apparatus.

Referring now to the drawings, wherein like reference numerals designate identical or corresponding parts throughout the several views illustrated, in particular, in FIG. 1, an image forming apparatus includes four photosensitive members shown as reference numbers 8Y, 8M, 8C, and 8BK. Respective yellow, magenta, cyan, and black toner images are formed on these PC members. First to third sheet feeding devices 9, 9A, and 9B are arranged in the image forming apparatus. A transfer belt 10 is arranged contacting all the PC members 8Y to 8BK to convey a sheet fed from any one of the sheet feeding devices 9 to 9B. Thus, each of the toner images is transferred from the PC members 8Y to 8BK and superimposed on the sheet P. The sheet now carrying the full-color toner image passes through a fixing station 11, and the full-color toner image is fixed onto the sheet due to its heat and pressure. The sheet having passed through the fixing station 11 is then ejected onto a sheet ejection tray 12.

A first sheet feeding device 9 is configured to manually feed placed by a user on a sheet feeding tray 1. Second and third sheet feeding devices 9*a* and 9*b* feed sheets P stacked on the sheet feeding trays 1A and 1B, respectively. Respective sheet feeding devices 9, 9A, and 9B include pickup rollers 2, 2A, and 2B launching a sheet P, feed rollers 3, 3A, and 3B arranged downstream of the pickup rollers 2, 2A, and 2B, and reverse rollers 4, 4A, and 4B coupled to the corresponding feed rollers 3, 3A, and 3B. A pair of registration rollers 13 is arranged downstream of the reverse roller 4 and feed roller 3 to be commonly used by the sheet feeding devices 9, 9A, and 9B. The sheet P launched from each of the sheet feeding trays 1, 1A, and 1B temporarily stops at the pair of the registration rollers 13 upon contact and is then fed in a portion between the PC members and transfer belt 10 when the pair of registration rollers 13 starts rotating at a prescribed time so that the sheet can accurately receive transfer of the full-color toner images formed on the PC members 8Y to 8BK.

Since configurations of sheet feeding devices 9, 9A, and 9B, the pickup rollers 2, 2A, and 2B, the feed rollers 3, 3A, and 3B, the reverse rollers 4, 4A, and 4B, and their accessory devices are substantially the same to each other, only configurations of the first sheet feeding device 9 and its rollers 2, 3, and 4 are described hereinafter.

Figure 2:
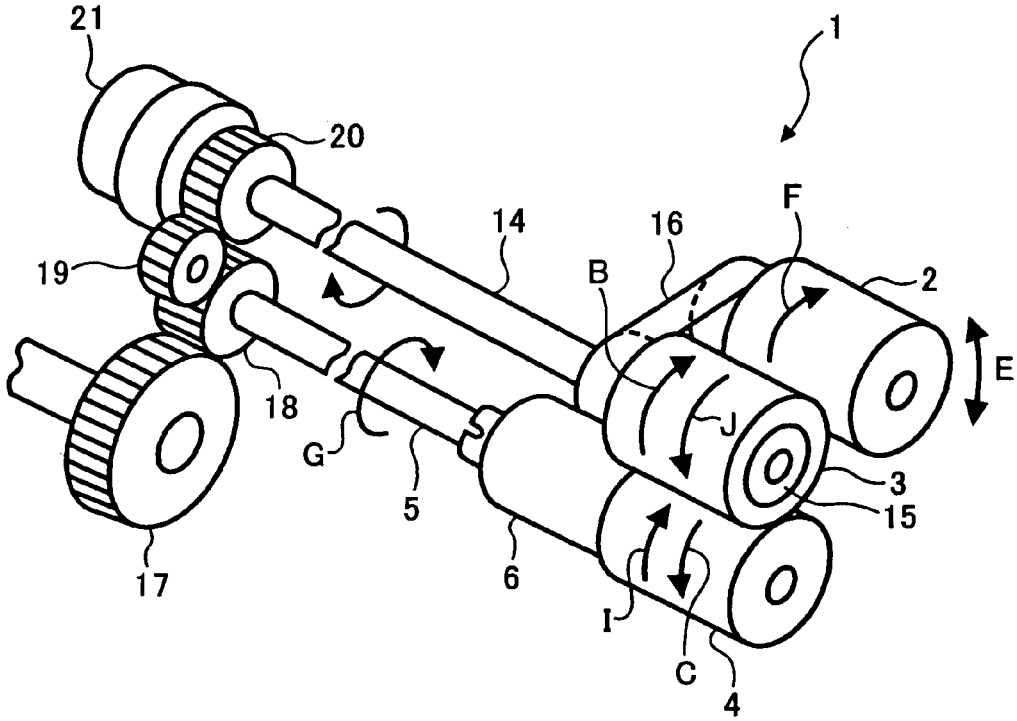
FIG. 2 is a perspective view illustrating the sheet feeding device shown in FIG. 1.

As shown in FIG. 2, the feed roller shaft 14 either supports, via a one-way clutch 15, or directly secures the feed roller 3. The pickup roller 2 is supported pivotally around a feed shaft 14 in a direction shown by the arrow E, and is connected to a feed roller 3 via a timing belt 16 so as to synchronously be driven and rotated by the feed roller 3. The reverse roller 4 is connected to the reverse shaft 5 via the torque limiter 6.

The driving gear 17 is rotationally driven by the driving motor (not shown), and is meshed with a reverse gear 18 secured to the reverse shaft 5. The reverse gear 18 is connected to a feed gear 20 freely rotatably supported by the feed shaft 14 via a midpoint gear 19. The feed shaft 14 includes a feed clutch 21, for example, an electromagnetic clutch.

Rotation of the driving motor is thus conveyed to the reverse shaft 5 via the driving gear 17 and reverse gear 18. Rotation of the reverse gear 18 is further conveyed to the feed gear 20 via the midpoint gear 19. When the feed clutch 21 is turned ON, rotation of the feed gear 20 is conveyed to the feed shaft 14 via the clutch 21, and both the feed and pickup rollers 3 and 2 are rotated in directions shown by arrows B and F, respectively. However, when the feed clutch 21 is turned OFF, the rotation of the feed gear 20 is not conveyed to the feed shaft 14.

Accordingly, the feed roller 3 is connectable to the driving motor via the feed clutch 21 that either connects or disconnects the driving motor from the feed roller 3. In addition, the reverse roller 4 is connected, via the torque limiter 6, to the reverse shaft rotationally driven by the driving motor. A stepping motor capable of highly and precisely controlled activation (i.e., ON/OFF) can be utilized as a driving motor.

Figure 3:
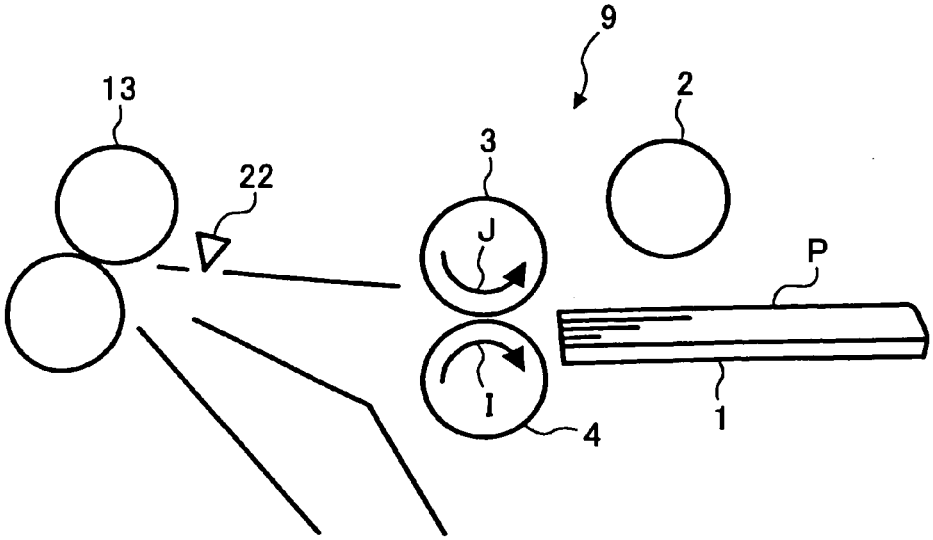
FIG. 3 is a schematic cross sectional view illustrating a condition of a sheet feeding device before a sheet is launched therefrom.
Figure 4:
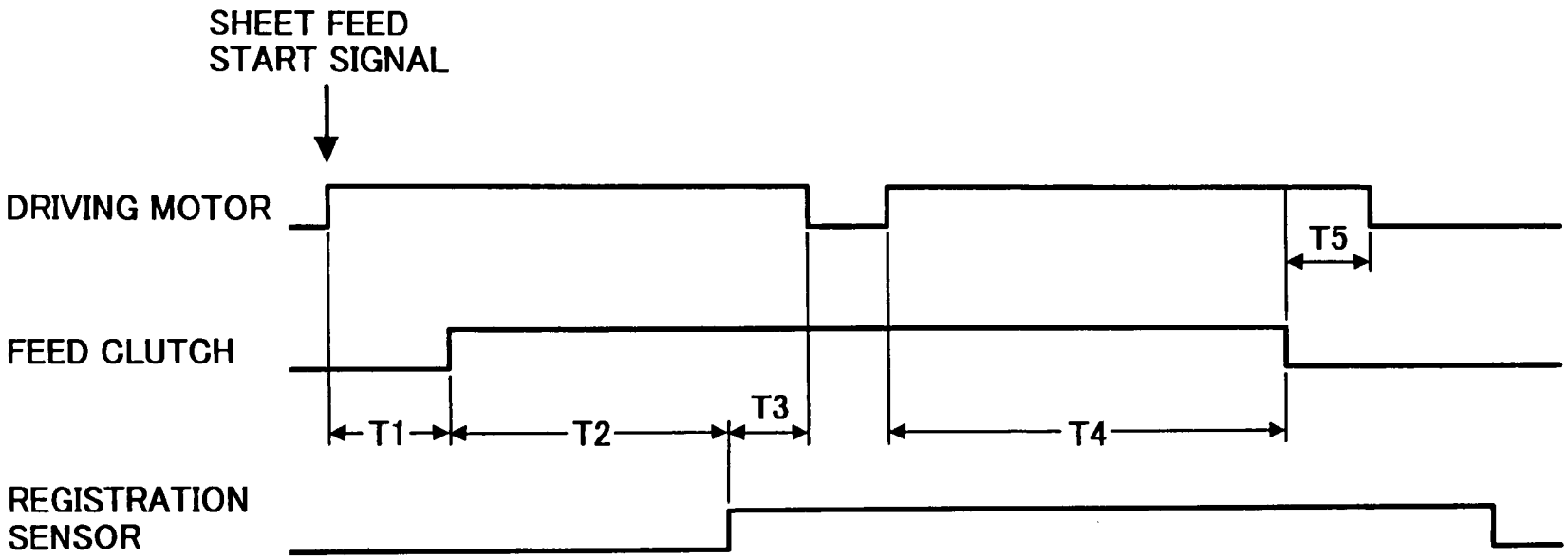
FIG. 4 is a time chart illustrating an exemplary behavior of a sheet feeding device.

Referring now to FIG. 4, a sheet feeding and returning operation is described. The driving motor initially starts operating upon receiving a sheet feed start signal. Rotation of the driving motor is conveyed and rotationally drives the reverse shaft 5 in a direction as shown by the arrow G (FIG. 2) via both of the driving and reverse gears 17 and 18. The pickup roller 2 is kept separated from the uppermost sheet P on the sheet feeding tray 1 as shown in FIG. 3. Since the feed clutch is being turned OFF, rotation of the driving motor is not conveyed to the feeding roller 3. Thus, the feed roller 3 is now capable to freely rotate together with the feed shaft 14. In addition, since the rotation of the reverse shaft 5 is conveyed and rotates the reverse roller 4 in the counter sheet feeding direction as shown by the arrow I in FIGS. 2 and 3 via the torque limiter 6, the feed roller 3 is driven by the reverse roller 4 in the counter sheet feeding direction as shown by the arrow J.

Figure 5:
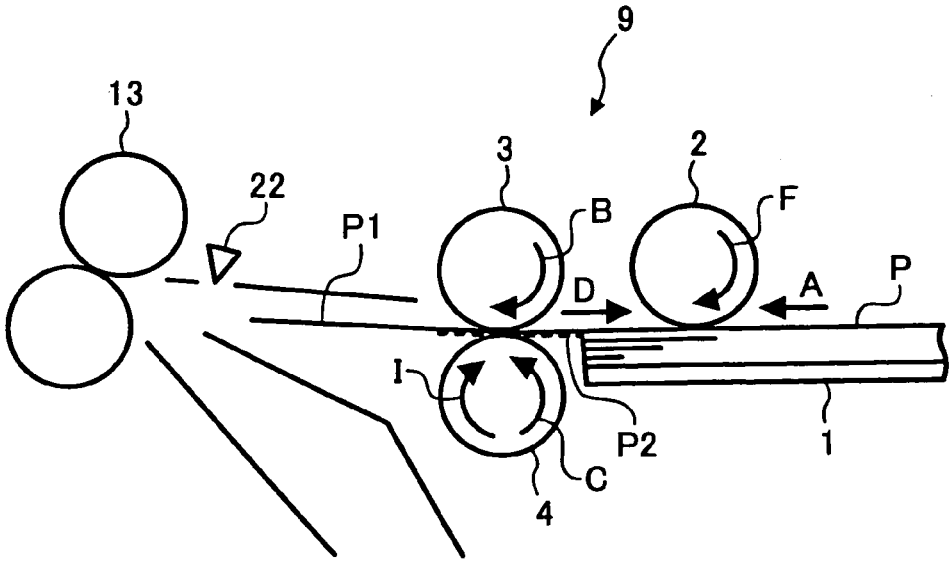
FIG. 5 is a schematic cross sectional view illustrating a condition of a sheet feeding device when a sheet is just launched therefrom.

When a prescribed time period T1 has elapsed after the driving motor starts rotation, the feed clutch 21 is turned ON and the pickup roller 2 descends and pressure contacts the uppermost sheet P as shown in FIG. 5. The rotation of the driving motor is then conveyed to and rotates both of the feed and pickup rollers 3 and 2 in directions as shown by arrows B and F in the drawing. The one-way clutch 15 conveys the rotation of the feed shaft 14 in this direction to the feed roller 3. Thus, the sheet P on the sheet-feeding tray 1 is launched in a direction as shown by the arrow A and pinched and conveyed by the feed and reverse rollers 3 and 4.

In such a device, only when one sheet P1 is fed in a nip formed between the feed roller 3, which is rotationally driven by the driving motor, and the reverse roller 4, is that the reverse roller 4 is engaged and driven by the moving sheet P1 in the sheet feeding direction as shown by arrow C by the torque limiter 6. In contrast, when one or more sheets P2 (shown by a dotted line) other than the sheet P1 are accidentally fed in the nip, the rotation of the reverse shaft 5, rotationally driven by the driving motor, is conveyed and rotates the reverse roller 4 in the counter sheet feeding direction as shown by arrow I via the torque limiter 6 so as to return the other sheet P2 contacting the reverse roller 4 in the direction as shown by arrow D.

After the feed and reverse rollers 3 and 4 pinch the sheet P launched from the sheet-feeding tray 1, the pickup roller 2 may preferably be separated from the uppermost sheet P on the sheet feeding tray. Otherwise, the pickup roller 2 may remain in contact with the uppermost sheet P.

Figure 6:
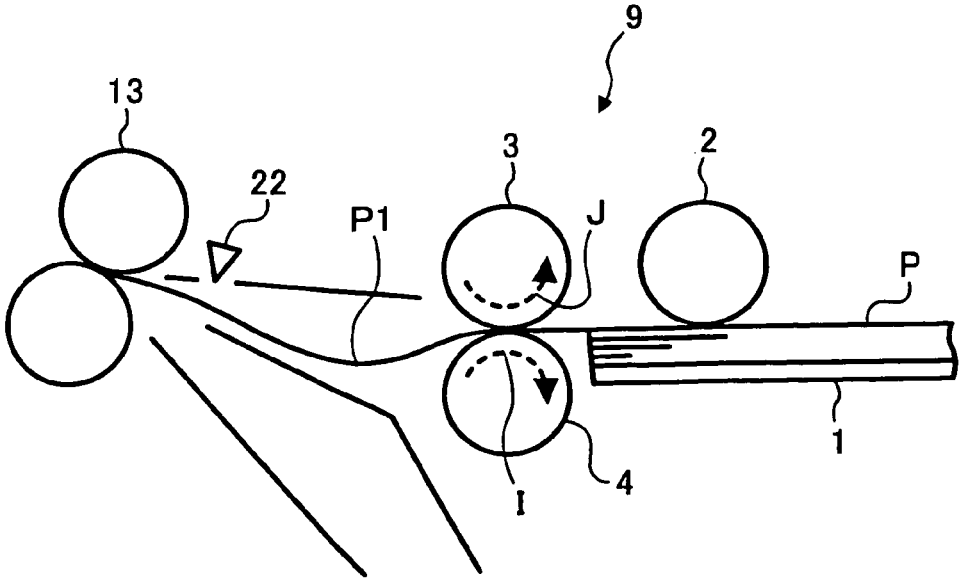
FIG. 6 is also a schematic cross sectional view illustrating a condition when a bending is formed in the sheet.

When the sheet P has been conveyed a time period T2 in the above-mentioned manner as shown in FIG. 4, a registration sensor 22 shown in FIG. 6 detects its leading edge. Subsequently, the leading edge makes contact with a pair of the registration rollers 13, thereby forming a bend in the sheet P as shown in FIG. 6. As a result, inclination of the sheet P is corrected. When a prescribed time period T3 has elapsed after the registration sensor 22 detects the leading edge of the sheet, the driving motor stops its rotation, and the driving force is no longer conveyed to the feed roller 3. Subsequently, the sheet P maintains its bending, because the feed clutch 21 maintains the activated condition (i.e., turned ON).

Subsequently, when toner images can be precisely transferred onto the sheet P1 from the respective PC members 8Y to 8BK (see FIG. 1), the pair of registration rollers 13 starts rotating, and the driving motor simultaneously restarts operating and rotationally drives the feed roller 3 in the sheet feeding direction.

As mentioned above, the leading edge of the sheet P collides with the pair of now stopping registration rollers 13, and is temporarily stopped after forming a bending. The pair of registration rollers 13 is then rotated at a prescribed timing so as to feed the sheet P. Thus, since the sheet P1 is temporarily stopped advancing by deactivating the driving motor while maintaining the feed clutch being turned ON, the bending does not fade out while the sheet feeding process is on a standby mode. That is, if the driving motor is stopped and the feed clutch 21 is tuned OFF, the reverse roller 4 is rotated by an anti-bending force generated in the bending sheet P1 in the counter sheet feeding direction as shown by dashed-line arrow I, and such a rotation is conveyed to the feed roller 3 in the same direction as shown by the dashed-line arrow J in FIG. 6, and accordingly, the bending fades out. Further, a bending is formed by turning OFF the feed clutch 21 while activating the driving motor, the bending will possibly fade out from the sheet P, because the reverse roller 4 is driven by the driving motor and rotates in the counter sheet feeding direction.

Then, in order to prevent the feed roller 3 from being rotated in the counter sheet feeding direction and fading out the bending by the reverse roller 4 attempting to rotate the feed roller 3, the preferred embodiment comprises the use of a hold torque generated by the driving motor. Specifically, such a hold torque is generated by directly connecting the driving motor to the feed roller 3 and stopping the driving motor while maintaining the feed clutch energized.

Figure 7:
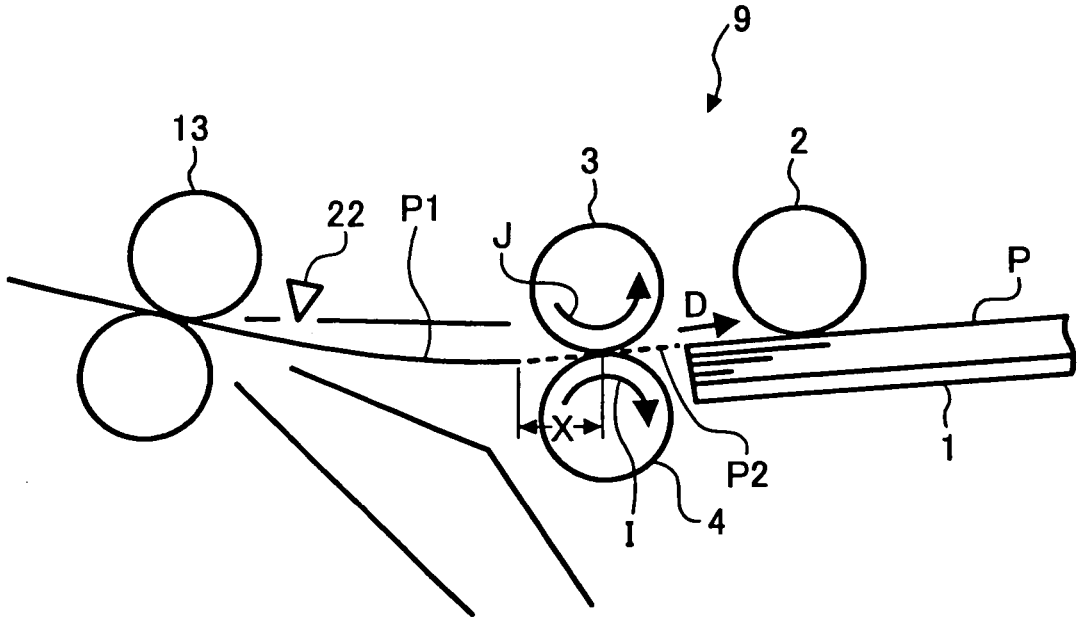
FIG. 7 is a schematic cross sectional view illustrating a condition when a trailing edge of a sheet escapes from a nip formed between feed and reverse rollers.

When the driving motor restarts rotating at a prescribed time as shown in FIG. 4 (i.e., at the second standup edge), the sheet P1 is further conveyed. The feed clutch 21 is then turned OFF when the trailing edge of the sheet P1 passes through the nip as shown in FIG. 7, specifically when the time T4 shown in FIG. 4 has elapsed. As a result, the sheet P1 is distanced from the nip by a length "X" as shown in FIG. 7. Since the feed clutch 21 is tuned OFF and motivity is not conveyed from the driving motor, the feed roller 3 becomes ready to freely rotate. The driving motor continuously operates, and rotation of the reverse shaft 5, rotationally driven by the driving motor, is conveyed to the reverse roller 4 via the torque limiter 6. Specifically, the reverse roller 4 is rotationally driven in the counter sheet feeding direction as shown by arrow I in FIG. 7, and the feed roller 3 is driven by the reverse roller 4 together with the feed shaft 14 in the counter sheet feeding direction as shown by arrow J. Thus, when another sheet P2 is pinched between the reverse and feed rollers 4 and 3 as shown by a dotted line, such a sheet is returned in the direction of arrow D to be distanced from the nip. Such an operation is executed per sheet feeding when sheets are continuously fed.

When the last sheet has been fed in series of sheet feeding operations, the driving motor is driven a time period T5 so as to return the other sheet P2 after turning OFF the feed clutch 21 as shown in FIG. 4. The driving motor stops operating when the other sheet P2 is distanced from the nip. When the sheet P is immediately fed, the driving motor can be maintained operating.

As mentioned above, since the next sheet P2 can be returned from the nip on a case-by-case basis, it does not remain at the nip, thereby preventing a sheet from jamming at the nip. Thus, even when a sheet feeding tray is withdrawn and attached again to the body of the image forming apparatus, a sheet jam can be eliminated. In addition, a reverse clutch as used in the art can also be eliminated, and a number of parts and cost of the sheet feeding device can be suppressed.

Further, in a known sheet feeding device, a feed clutch is turned OFF and a sheet P is then pulled by a pair of gripping rollers while pinching the sheet P together with the feed and reverse rollers. According to such a sheet feeding device, a feed roller conveys the sheet P unless a feed clutch is tuned OFF, and does not feed when the feed clutch is turned OFF. Thus, the load on the pair of gripping rollers sharply changes when the feed clutch is turned ON/OFF, causing the driving motor to awkwardly drive the pair of gripping rollers. If such a driving motor also drives a PC member, for example, the PC member receives impact and possibly generates unevenness of an image. Further, even if a pair of gripping rollers is excluded, since the reverse and feed rollers pull a sheet P upstream, the sheet feeding speed of the pair of registration rollers changes, thereby deforming the image at its midpoint.

In the sheet feeding device of one of the preferred embodiments, however, because the feed clutch 21 is turned OFF after the trailing edge of the sheet has passed through the nip, the above-mentioned problem is eliminated, and a high quality image is obtained.

Further, as mentioned above, since a reverse shaft 5 is rotationally driven by the driving motor a time period T1 as shown in FIG. 4, and the driving motor is disconnected from the roller 3 so as to enable the feed roller 3 to freely rotate before the pickup roller 2 firstly starts feeding sheets, a sheet jam can be suppressed even when the sheets are roughly set especially using a manual sheet feeding device.

Figure 8:
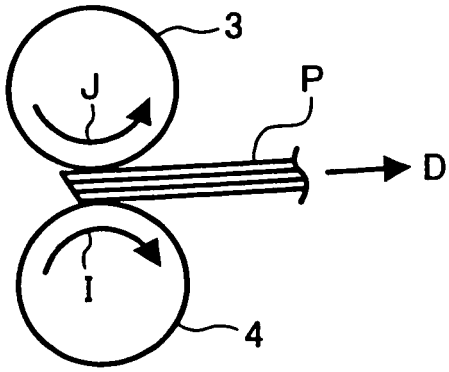
FIG. 8 is a schematic cross sectional view illustrating a condition when plural sheets are pushed into a nip formed between feed and reverse rollers from a manual sheet feeding tray.
Figure 9:
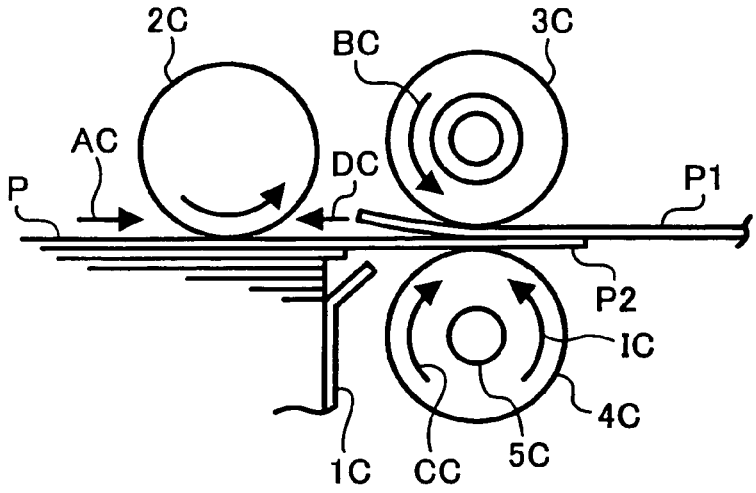
FIG. 9 PRIOR ART
FIG. 9 is a schematic cross sectional view illustrating a known sheet feeding device.
Figure 10:
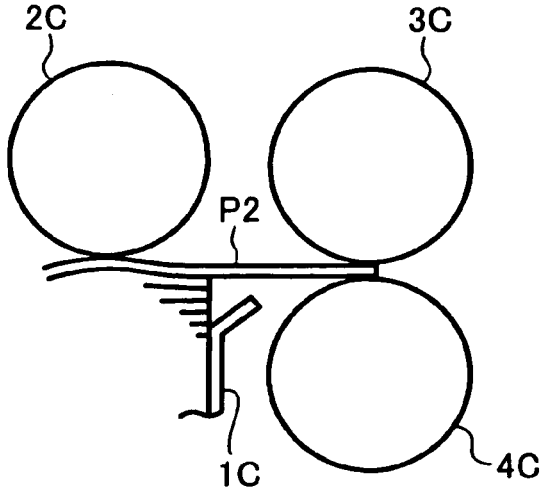
FIG. 10 PRIOR ART
FIG. 10 is a schematic cross sectional view illustrating the next sheet pinched and stopped between feed and reverse rollers of the known sheet feeding device.

Stated differently, if a user intensively pushes and sets plural sheets P on the manual sheet feeding tray 1, the plural sheets are fed in a nip formed between the feed and reverse rollers 3 and 4, as shown in FIG. 8, possibly causing a sheet jam in a known sheet feeding device when the sheets are launched therefrom. In order to suppress such a problem, multiple sheet insertion is generally detected when the sheets are pushed into the nip so that such an effect can be brought to the attention of the user with a buzzer or warming light so as to alert the user to freshly reset the sheets in the feeder. However, such a sheet feeding device is costly.

According to the sheet feeding device of one of the preferred embodiments, because the reverse shaft 5 is rotationally driven and the feed roller 3 freely rotates before sheet feeding is commenced, the reverse roller 4 rotates in the counter sheet feeding direction shown by arrow I and the feed roller 3 rotates in the direction shown by arrow J in FIG. 8, the sheets pushed into the nip can be returned in a direction shown by arrow D. Thus, the user can automatically reset sheets at an appropriate position, and accordingly, eliminating or reducing significantly sheet jam incidents.

Further, in the image forming apparatus of FIG. 1, including a plurality of sheet feeding devices 9, 9A, and 9B, if only one motor is commonly used by the plurality of sheet feeding devices as a driving motor, the overall cost (of the device) can be significantly reduced.

However, since the feed clutch is maintained in the OFF position and the load on the reverse roller is not substantial, avoiding generation of torque in the torque limiter when rotating in the counter sheet feeding direction, and thereby reducing proportionately the required power and extending the life of the torque limiter.

The return of a sheet remaining in the improved feeding device will now be described with reference to FIGS. 11 to 14. When a sheet jam occurs in the fixing station 11, or in a similar section during continuous sheet feedings performed in accordance with the earlier mentioned process, the driving motor is stopped in order to prevent subsequent sheets from contacting the jammed sheet. The occurrence of the sheet jam is displayed on a display section to alert and instruct a user to deal with the jam and succeeding sheets.

In such a situation, since it is generally difficult for the user to judge if a sheet slightly fed from the sheet feeding tray 1 is to be removed, such a sheet is generally neglected and left as it is. The user then generally checks if a sensor detects such a sheet after removing the jammed and prescribed succeeding sheets from the fixing station and similar section (in step S1). If the sheet is detected (Yes, in step S1), the sheet feeding motor is rotated for a prescribed time period so as to return a sheet by a length longer than a distance between a nip of the registration rollers 13 and that of the feed and reverse rollers of the manual feeding device (in steps S2 and S3). As a result, the slightly fed sheet P is returned to its original position as mentioned earlier.

A similar operation is performed when power is initially supplied to the image forming apparatus, assuming that a user has turned OFF the power supply after a sheet jam occurred and the device recovered.

Figure 12:
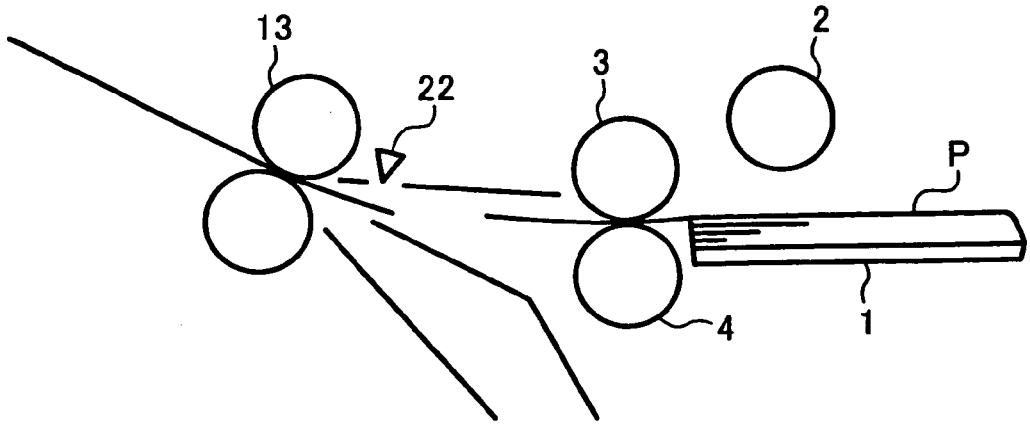
FIG. 12 is a cross sectional view of the sheet feeding device illustrating an exemplary sheet stopping position of the next sheet when jamming occurs.
Figure 13:
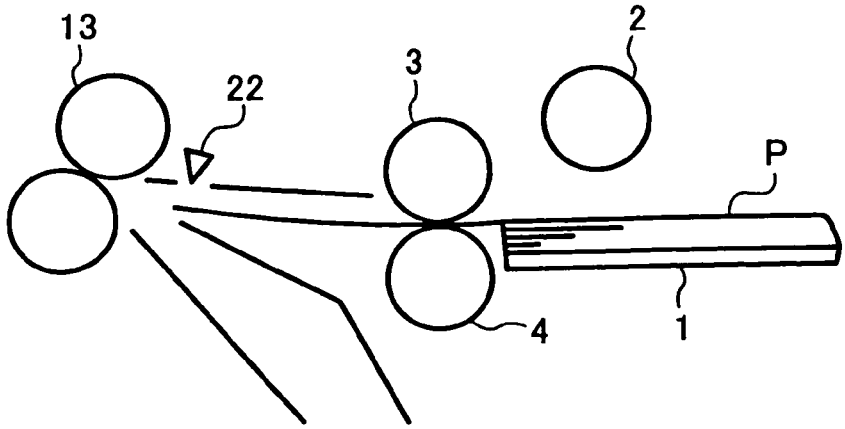
FIG. 13 is also a cross sectional view of the sheet feeding device illustrating still another exemplary sheet stopping position of the next sheet when jamming occurs.
Figure 14:
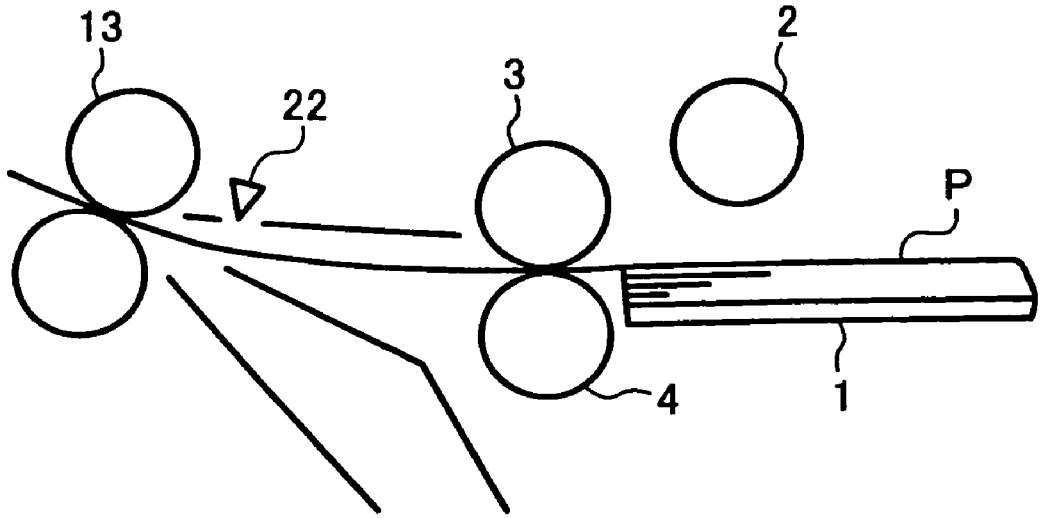
FIG. 14 is a cross sectional view of the sheet feeding device illustrating still another exemplary sheet stopping position of the next sheet when jamming occurs.

The above-mentioned sheet returning operations are now described in more detail in relation to sheet stoppage positions in the sheet feeding device with reference to FIGS. 12 to 14.

Figure 11:
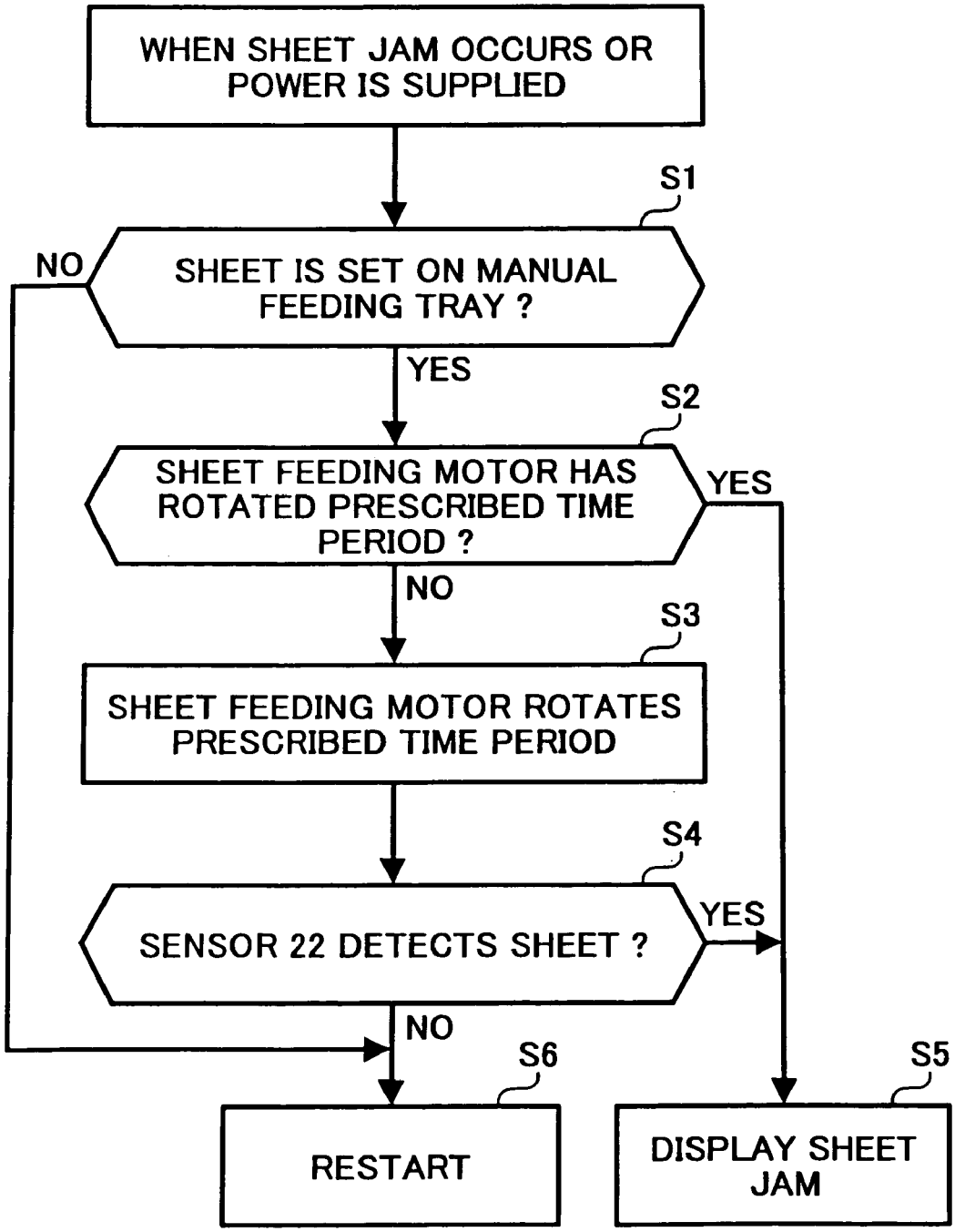
FIG. 11 is a flowchart illustrating an exemplary sheet returning operation.

As shown in FIG. 12, when a sheet P is left in the nip formed between the registration rollers 13, such a sheet is no longer useful. In contrast, the next sheet that is only slightly fed from the manual sheet feeding section can be used again. In light of the same, sheet detection of a registration sensor 22 for stopping the operation of the image forming apparatus and sheet feeding device is neglected as shown in FIG. 11. The driving motor and, accordingly, the reverse roller are, however, continuously rotated for independent periods of time, thereby returning a sheet that has been slightly fed from the manual sheet feeding section to its original position as mentioned earlier. However, if already nipped and left between the registration rollers 13, such a sheet P is determined thereafter as a jammed sheet, and the occurrence is display so as to alert the user to deal with the jammed sheet (in step S5).

When a sheet arrives and is detected by the registration sensor 22 as shown in FIG. 13, a known operation may immediately regards the sheet as a jammed sheet. In a modified embodiment, however, since the driving motor is independently rotated a prescribed time period from the sheet detection, the reverse roller returns the sheet to its original position similar to the above-described process. Specifically, the sheet P returns and deviates from the detection position of the registration sensor 22, making the sheet feeding device ready to restart operation.

Further, when a sheet arrives at the pair of the registration rollers and is determined as a jammed sheet by a known sheet feeding device as shown in FIG. 14, the driving motor is similarly independently rotated a prescribed time period from the sheet detection. However, since being nipped by the pair of the registration rollers 13, such a sheet cannot return and thus remains at the previous position even if the prescribed time period has elapsed. Thus, the image forming apparatus displays the effect so as to alert the user to deal with the jammed sheet.

Accordingly, these operations assure that a usable sheet is not disposed of by the user and is automatically returned to a position right before the nip of the feed and reverse rollers 3 and 4 by the above-mentioned sheet returning operation. As a result, a sheet restarting position is optimized when the sheet is returned. Thus, a sheet jam is accordingly suppressed when the sheet feeding is restarted.

A stepping motor capable of precisely timing stoppage and similar device are more preferably employed for the above-mentioned driving motor.

Numerous additional modifications and variations of the present invention are possible in light of the above teachings. It is therefore to be understood that within the scope of the appended claims, the present invention may be practiced otherwise than as specifically described herein.

What is claimed is:

1. A sheet feeding apparatus, comprising:

a sheet tray configured to stack at least a sheet;

a pickup roller operatively configured to feed the sheet in a sheet feeding direction, the sheet feeding direction being from the sheet tray toward a location where an image is formed on the sheet;

a feed roller arranged downstream of the pickup roller in a sheet feeding direction and operatively configured to launch the sheet;

a driving motor being connected to the feed roller via a feed clutch, said feed clutch being configured to selectively connect and disconnect transmission of the driving motor to the feed roller;

a reverse roller contacting the feed roller and connected to a reverse shaft driven by the driving motor via a torque limiter, said reverse roller being engaged with the sheet and driven in a sheet feeding direction by an operation of the torque limiter when only the sheet is fed in between the feed roller driven by the driving motor in the sheet feeding direction and the reverse roller, said reverse roller being operatively configured to reversely rotate and return another sheet in contact therewith in a counter sheet feeding direction while receiving rotation of the reverse shaft driven by the driving motor by the operation of the torque limiter when the other sheet is fed in beside the sheet to be fed between the feed roller driven by the driving motor and the reverse rollers, wherein said feed clutch is turned OFF when a trailing edge of the sheet to be fed passes through a nip formed between the feed and reverse rollers so as to disconnect the transmission to the feed roller in order to enable the feed roller to freely rotate, and wherein the rotation of the reverse shaft is transmitted to the reverse roller by the operation of the torque limiter so as to enable the reverse roller to rotate and return the next sheet nipped by the reverse and feed rollers in the counter sheet feeding direction;

a pair of registration rollers arranged downstream of the feed and reverse rollers;

a controller controlling the sheet feeding apparatus such that:

the sheet is temporarily stopped after a leading edge thereof contacts the pair of the registration rollers and a bending is formed therein, and said sheet is then fed by rotating the pair of the registration rollers a prescribed time, wherein said temporary stoppage of the sheet is achieved by deactivating the driving motor while turning ON the feed clutch, said driving motor is driven a prescribed time period to rotate the reverse roller before restarting sheet feeding after a sheet jam occurs and the sheet feeding apparatus is temporarily stopped, said reverse shaft is driven by the driving motor and said feed clutch is turned OFF for a time period T1 so as to disconnect the transmission to the feed roller in order to enable the feed roller to freely rotate before the pickup roller firstly starts feeding the sheet, and when a last sheet has been fed in series of sheet feeding operations, the feed clutch is turned OFF at a time T4 and the driving motor is driven for a further time period T5, wherein T1>T5.

2. The sheet feeding apparatus according to claim 1, wherein said reverse roller is rotated even if the sheet remaining on a sheet feeding path in the sheet feeding device is detected.

3. The sheet feeding apparatus according to claim 2, wherein a distance calculated by multiplying an average sheet feeding velocity by said prescribed time period corresponds to a distance substantially the same or longer than a distance between the nip formed between the feed and reverse rollers and a nip formed between the registration rollers.

4. An image forming apparatus comprising a plurality of sheet feeding apparatuses as claimed in claim 1, wherein a driving motor is commonly used by the plurality of sheet feeding apparatuses.

* * * * *